United States Patent [19]

Van Raaij

[11] Patent Number: 4,555,825

[45] Date of Patent: Dec. 3, 1985

[54] HYDRAULIC COOLING SYSTEM FOR VACUUM STREET SWEEPER

[76] Inventor: Karel W. M. Van Raaij, Pettemerstraat 17-23, P.O. Box 286, 1800 AG Alkmaar, Netherlands

[21] Appl. No.: 579,168

[22] Filed: Feb. 10, 1984

[51] Int. Cl.[4] ..... E01H 1/08

[52] U.S. Cl. ..... 15/339; 15/340; 60/456

[58] Field of Search ..... 15/339, 340, 349; 60/456

[56] References Cited

U.S. PATENT DOCUMENTS

| | | | |
|---|---|---|---|
| 3,165,775 | 1/1965 | Lutz | 15/340 X |
| 3,173,777 | 3/1965 | Tamny | 15/340 X |
| 3,197,798 | 8/1965 | Brown et al. | 15/340 X |
| 3,604,051 | 9/1971 | Wendel et al. | 15/340 |
| 4,069,972 | 1/1978 | Hausmann | 60/456 X |

*Primary Examiner*—Chris K. Moore

*Attorney, Agent, or Firm*—Rogers, Howell, Moore & Haferkamp

[57] ABSTRACT

A hydraulically actuated vacuum street sweeper (2) of the motorized vehicular type includes a vacuum system (12) with a vacuum blower (14) for suctioning debris, and a cooling system (50) utilizing otherwise wasted exhaust air from the blower for cooling hydraulic oil. Hydraulic conduit (52) is in the exhaust path of the vacuum blower and cooled by exhaust air from the latter.

10 Claims, 3 Drawing Figures

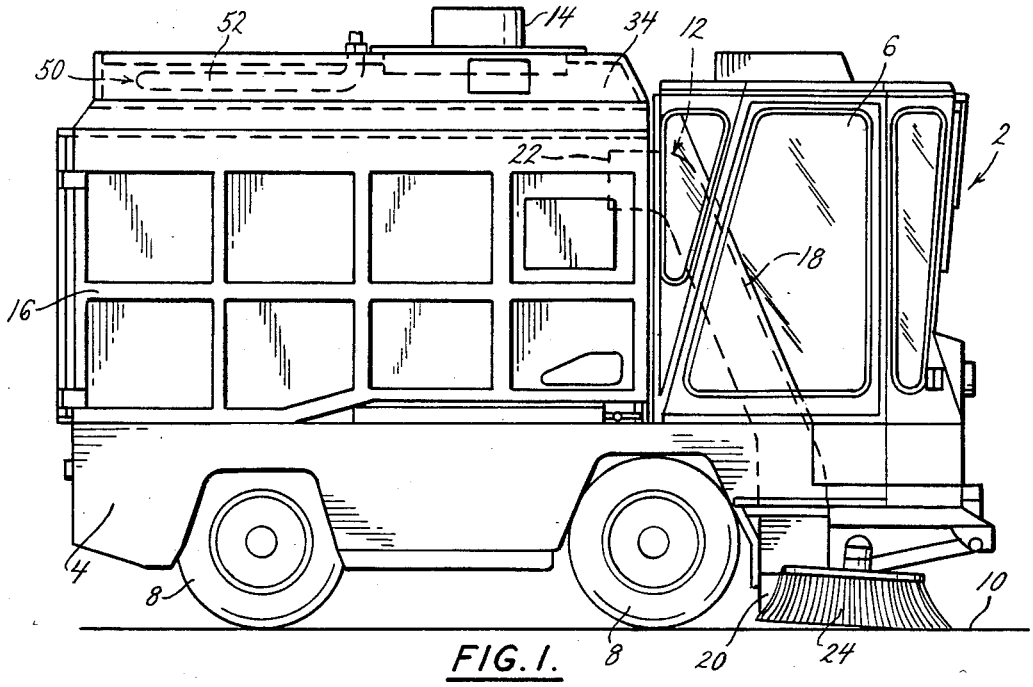
FIG. 1.
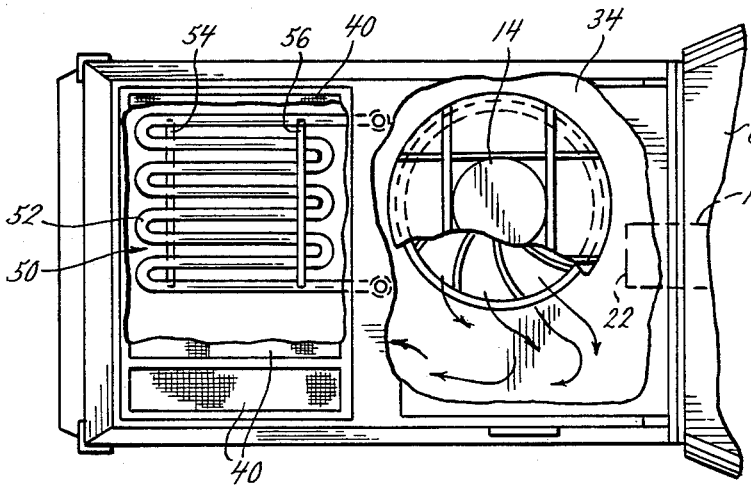
FIG. 2.
FIG. 3.
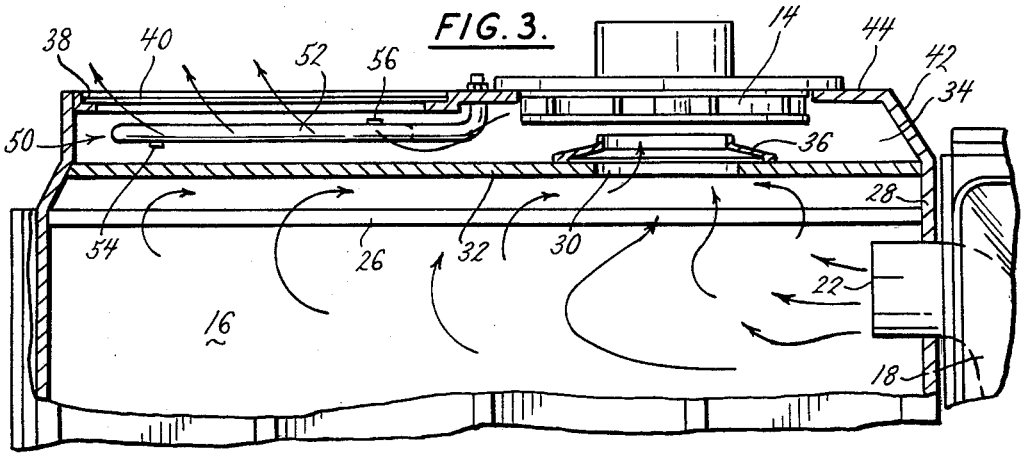

HYDRAULIC COOLING SYSTEM FOR VACUUM STREET SWEEPER

BACKGROUND AND SUMMARY

The invention relates to a vacuum street sweeper, including the motorized vehicular type having one or more hydraulically driven components, such as a vacuum blower, brooms, and steering unit.

The harder the hydraulic components work, the hotter the hydraulic oil becomes. Known sweepers typically rely upon either a large oil sump for cooling, or an oil cooler placed in front of the engine radiator.

In the present invention, an efficient cooling system for the hydraulic work circuit is provided, which may be used alone or in combination with the above-noted cooling systems. Means are provided for utilizing otherwise wasted exhaust air from the vacuum blower for cooling hydraulic oil. Hydraulic conduit is disposed in the exhaust path of the vacuum blower and is cooled by the latter. The faster the blower runs, the more air flows across the conduit for cooling. The invention does not interfere with the primary purpose of the blower in developing suction for cleaning, yet facilitiates usage of the exhausted air which is otherwise unutilized.

The hydraulic cooling system in accordance with the invention facilitiates a particulary compact sweeper. This is due to multiple utilization of available space, and to the elimination, if desired, of space otherwise needed for auxiliary cooling systems.

BRIEF DESCRIPTION OF THE DRAWINGS

FIG. 1 is a side elevation view of a vacuum street sweeper incorporating a hydraulic cooling system in accordance with the invention.

FIG. 2 is a top view partially cut away of the structure of FIG. 1.

FIG. 3 is an enlarged partial sectional view of a portion of FIG. 1.

DETAILED DESCRIPTION

There is shown in FIG. 1, a hydraulically actuated vacuum street sweeper 2 of the motorized vehicular type including a frame or chassis 4 and operator cab 6 supported on wheels 8 on street surface 10. The sweeper includes a vacuum system 12 with a hydraulically driven vacuum blower 14 for suctioning debris from street surface 10 and depositing the debris in hopper 16. The vacuum system includes an intake section 18 upstream of hopper 16 for suctioning debris at intake nozzle 20 and transmitting the debris to an inlet port 22 in the hopper, FIG. 3. Intake nozzle 20 is proximate street surface 10 and between a pair of hydraulically driven oppositely rotating brooms, such as 24 which sweep and channel debris toward nozzle 20.

An initial coarse filter screen or perforated wall 26, FIG. 3, in the hopper separates inlet port 22 in side wall 28 of the hopper from an outlet port 30 in top wall 32 of the hopper. Debris entering inlet port 22 is blocked by screen 26 from reaching outlet port 30, and the debris settles in the bottom of hopper 16. Screen or wall 26 is coarse enough to minimize and reduction in vacuum power and permits passage of dust therethrough.

Vacuum system 12 further includes an exhaust section 34 downstream of hopper 16 for suctioning dust and the like from outlet port 30 of the hopper. Vacuum blower 14 is in exhaust section 34 and provides the noted suctioning. Exhaust section 34 has a flanged inlet

36 from the hopper outlet port 30, and has an outlet to the atmosphere through an exhaust port 38 which may include one or more fine mesh or cloth filters 40 for dust filtration and reduction of air pollution. Exhaust section 34 is formed by a compartment 42 above hopper 16. Blower 14 is in the top wall 44 of the compartment and draws air from the hopper at port 30 and then directs it leftwardly through compartment 42 for exit through exhaust port 38 in top wall 44 laterally spaced from the blower.

Means 50 are provided for utilizing otherwise wasted exhaust air from the blower for cooling hydraulic oil. The cooling system is provided by hydraulic conduit means 50, FIGS. 2 and 3, in the exhaust path of the blower and cooled by exhaust air from the latter. Conduit 52 is a metal tube bent in a planar serpentine manner and is supported by cross bars 54 and 56 parallel to top wall 44 of compartment 42 adjacently beneath exhaust port 38 and filters 40. This design facilitates a flat compact exhaust section compartment.

Conduit 52 is disposed in the exhaust passage air flow path between blower 14 and exhaust port 38. The harder the sweeper works and the faster the blower runs, the more air flows across conduit 52 for cooling. Exhaust air from blower 14 directly impinges conduit 52, without intermediate filtering, to maximize exhaust cooling power. Screen 26 protects conduit 52 against damage from debris.

It is recognized that various modifications are possible within the scope of the appended claims.

I claim:

1. In a vacuum street sweeper having at least one hydraulically driven component, a vacuum system with an exhaust section, the exhaust section including a compartment, a vacuum blower housed in the compartment for suctioning air carrying debris and dust, and an exhaust port from the compartment serving as an outlet for air to the atmosphere, filter means immediately upstream of the exhaust port for filtering air prior to its passage through the exhaust port, hydraulic oil conduit means, means for mounting the hydraulic oil conduit means adjacent and upstream of the filter means for utilizing otherwise wasted exhaust air from said blower for cooling hydraulic oil prior to passage of the air through the filter means.

2. In a hydraulically actuated vacuum street sweeper having a vacuum system with a vacuum blower for suctioning debris, means for utilizing otherwise wasted exhaust air from said blower for cooling hydraulic oil, said means comprising a cooling system including hydraulic conduit means in the exhaust path of said vacuum blower and cooled by exhaust air from the latter, said vacuum system having an exhaust section including a compartment, said compartment having an exhaust port and housing said blower and said conduit means, said conduit means being disposed in the exhaust air flow path between said blower and said exhaust port, such that the harder said sweeper works and the faster said blower runs, the more air flows across said conduit means for cooling, said exhaust port being formed in a given wall of said compartment;

said conduit means being bent in a planar serpentine manner and being parallel to and adjacent said exhaust port; and said blower being mounted in said given wall of said compartment laterally spaced from said conduit means and exhaust port, to afford a flat compact exhaust section compartment.

3. A hydraulically actuated vacuum street sweeper comprising:

a hopper for receiving debris, the hopper having an inlet port and an outlet port;

a vacuum system for suctioning debris and depositing same in said hopper, comprising:

an intake section upstream of said hopper for suctioning debris and transmitting said debris to the inlet port in said hopper; and an enclosed exhaust section downstream of said hopper and in communication with the outlet port for suctioning air carrying dust and the like from the outlet port in said hopper, the exhaust section including an upper wall, an exhaust port in the upper wall of the exhaust section for discharging air from the exhaust section;

a hydraulically driven vacuum blower in said exhaust section between the outlet port and the exhaust port for providing said suctioning;

hydraulic conduit means for conveying hydraulic fluid to the blower, and for supporting the hydraulic conduit means in said exhaust section beneath the exhaust port for cooling the hydraulic fluid by exhaust air from said blower;

said hopper inlet port being in a side wall of said hopper;

said hopper outlet port being in a top wall of said hopper;

said exhaust section comprises a compartment above said hopper; and said blower being in a top wall of said compartment above said hopper outlet port.

4. A hydraulically actuated vacuum street sweeper comprising:

a hopper for receiving debris having an inlet port in a side wall of said hopper and an outlet port in a top wall of said hopper, a vacuum system for suctioning debris and depositing same in said hopper, including:

an intake section upstream of said hopper for suctioning debris and transmitting the debris to the inlet port in said hopper;

an exhaust section downstream of said hopper for suctioning air carrying dust and the like from the inlet port in said hopper, the exhaust section having an exhaust port to the atmosphere, the exhaust section having an inlet communicating with the outlet port, and the exhaust section including a compartment above the hopper, a vacuum blower in the exhaust section for providing suctioning, the blower being between the exhaust section inlet and the exhaust port, the blower being in a top wall of the compartment above the hopper outlet port, said exhaust port being in said top wall of said compartment laterally spaced from said blower; and hydraulic conduit means in the exhaust section cooled by exhaust air from the blower, the hydraulic conduit means being between the blower and the exhaust port, said hydraulic conduit means being beneath said exhaust port.

5. The street sweeper according to claim 4, wherein said hydraulic conduit means is bent in a planar serpentine manner and is parallel to said top wall of said compartment.

6. The street sweeper according to claim 3, comprising:

an initial coarse filter screen in said hopper separating said inlet port and said outlet port such that debris entering said inlet port is blocked from reaching said outlet port and settles in said hopper; and wherein exhaust air from said blower directly impinges said hydraulic conduit means without intermediate filtering, to maximize exhaust cooling power.

7. A hydraulically actuated vacuum street sweeper comprising:

a hopper for receiving debris and having an inlet port in a side wall thereof and an outlet port in a top wall thereof;

an initial coarse filter screen in said hopper separating said inlet and outlet ports, such that debris entering said inlet port is blocked from reaching said outlet port and settles in said hopper, said initial coarse filter screen permitting the passage of dust and the like therethrough to minimize reduction of vacuum power;

a vacuum system for suctioning debris from the street and depositing same in said hopper, and for suctioning dust and the like from said hopper, comprising:

an intake section upstream of said hopper for suctioning debris and transmitting said debris to said hopper inlet port; and an exhaust section downstream of said hopper for suctioning dust and the like from said hopper outlet port, and including a flat compartment above said hopper having an inlet from said hopper outlet port and having an outlet to the atmosphere through an exhaust port in the top wall of said compartment;

a vacuum blower in said exhaust section, providing said suctioning, mounted in said top wall of said compartment above said hopper outlet port laterally spaced from said exhaust port in said top wall of said compartment such that said blower is between said exhaust section compartment inlet and said exhaust port; and hydraulic conduit means in said exhaust section compartment beneath said exhaust port, between said blower and said exhaust port, and cooled by exhaust air from said blower.

8. The street sweeper according to claim 4 including cross bar members affixed to the hydraulic conduit means to support the hydraulic conduit means.

9. In a hydraulically actuated vacuum street sweeper having a vacuum system including a hopper having an inlet port and an outlet port for receiving debris, an exhaust section in communication with the hopper downstream thereof, the exhaust section including a compartment with an exhaust port, an inlet to the compartment in communication with the hopper outlet port, exhaust filter means extending substantially across the exhaust port, a vacuum blower within the compartment for suctioning air and debris into the hopper inlet, and means for utilizing exhaust air from the blower for cooling hydraulic fluid comprising hydraulic conduit means disposed adjacent the exhaust filter means in the path of the exhaust air.

10. In a hydraulically actuated vacuum street sweeper having a vacuum system including an exhaust section, a compartment having top, bottom, and side walls, a vacuum blower within the compartment for suctioning debris, an exhaust port through a wall of the compartment, a cooling system including hydraulic conduit means within the compartment between the vacuum blower and the exhaust port such that the harder the sweeper works and the faster the blower runs, the more air flows across the conduit means for cooling, the blower being spaced laterally from the conduit means and exhaust port, to afford a flat compact compartment.

* * * * *